US008677695B2

(12) United States Patent
McCoy

(10) Patent No.: US 8,677,695 B2
(45) **Date of Patent: *Mar. 25, 2014**

(54) EAVES TROUGH DETRITUS DETERRENT APPLIANCE

(71) Applicants: Jeffrey N. McCoy, Lincoln, CA (US); William J. Stoll, II, Lincoln, CA (US)

(72) Inventor: Jeffrey N. McCoy, Lincoln, CA (US)

(73) Assignees: Jeffrey N. McCoy, Lincoln, CA (US); William J. Stoll, II, Lincoln, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/914,409

(22) Filed: Jun. 10, 2013

(65) Prior Publication Data

US 2013/0276379 A1 Oct. 24, 2013

Related U.S. Application Data

(63) Continuation-in-part of application No. 13/208,212, filed on Aug. 11, 2011, now Pat. No. 8,495,837.

(60) Provisional application No. 61/374,928, filed on Aug. 18, 2010.

(51) Int. Cl.
*E04D 13/00* (2006.01)

(52) U.S. Cl.
USPC ..... 52/12

(58) Field of Classification Search
USPC ..... 52/11–13, 15
See application file for complete search history.

(56) References Cited

U.S. PATENT DOCUMENTS

| | | | | |
|---|---|---|---|---|
| 5,189,849 | A | 3/1993 | Collins | |
| 5,842,311 | A | 12/1998 | Morin | |
| 5,893,240 | A | 4/1999 | Ealer, Sr. | |
| 6,134,843 | A | 10/2000 | Tregear | |
| 6,598,352 | B2 | 7/2003 | Higginbotham | |
| 7,310,912 | B2 | 12/2007 | Lenney et al. | |
| 8,495,837 | B2 * | 7/2013 | McCoy | 52/12 |
| 2003/0046876 | A1 | 3/2003 | Higginbotham | |
| 2005/0138866 | A1 | 6/2005 | Kim | |
| 2006/0107603 | A1 | 5/2006 | Brownridge | |
| 2006/0123710 | A1 | 6/2006 | Lenney et al. | |
| 2007/0234647 | A1 * | 10/2007 | Higginbotham | 52/12 |
| 2008/0163561 | A1 * | 7/2008 | Lenney et al. | 52/12 |
| 2010/0287846 | A1 * | 11/2010 | Lenney | 52/12 |
| 2011/0067318 | A1 * | 3/2011 | Lenney et al. | 52/12 |

* cited by examiner

*Primary Examiner* — Brian Glessner
*Assistant Examiner* — Brian D Mattei
(74) *Attorney, Agent, or Firm* — Perkins Coie LLP

(57) ABSTRACT

A detritus exclusion appliance includes a support that is preferably, but not necessarily, constructed of extruded aluminum and that comprises a screen made of surgical grade stainless steel wire mesh that prevents debris from entering rain gutters. The support is preferably formed of an extruded material that includes one or more upwardly projecting support beams. A center beam may project upwardly beyond beams to either side of it to create a curved profile in which the wire mesh is curved along an axis of the support to slope downwardly on either side of the center beam. This arrangement assists in shedding detritus and debris from the screen. Various embodiments are described.

17 Claims, 8 Drawing Sheets

EAVES TROUGH DETRITUS DETERRENT APPLIANCE

CROSS REFERENCE TO RELATED APPLICATIONS

This application is a continuation-in-part of U.S. patent application Ser. No. 13/208,212, filed Aug. 11, 2011, which claims priority from U.S. provisional patent application Ser. No. 61/374,928, filed Aug. 18, 2010, each of which is incorporated herein in its entirety by this reference thereto.

BACKGROUND OF THE INVENTION

1. Technical Field

The invention relates to eaves troughs. More particularly, the invention relates to an eaves trough detritus deterrent appliance.

2. Description of the Background Art

An eaves trough, eaves channel, guttering, or gutter is a narrow channel, or trough, forming the component of a roof system which collects and diverts rainwater shed by the roof. An eaves trough may be a roof integral trough along the lower edge of the roof slope which is fashioned from the roof covering and flashing materials.

Other forms of eaves trough, however, are known. For example, FIG. 1 is a perspective view of a conventional eaves trough installed to the edge of roof to catch rainwater shed by the roof and divert it to a downspout. In FIG. 1, a discrete trough 10 of metal, or other material is suspended beyond the roof edge and below the projected slope of the roof 11 to catch rainwater shed by the roof of the structure and divert it to a downspout 12.

An eaves trough may also be a wall integral structure beneath the roof edge, traditionally constructed of masonry, fashioned as the crowning element of a wall; or a box gutter, which is a deep gutter which is concealed within the structure of the roof.

The main purpose of an eaves trough is to protect a building's foundation by channeling water away from its base. They also help to reduce erosion, prevent leaks in basements and crawlspaces, protect painted surfaces by reducing exposure to water, and provide a means to collect rainwater for later use.

Eaves troughs can be constructed from a variety of materials, including cast iron, lead, zinc, galvanized steel, painted steel, copper, painted aluminum, PVC and other plastics, concrete, stone, and wood.

Water collected by a rain gutter is fed, usually via a downspout (traditionally called a leader or conductor), from the roof edge to the base of the building where it is either discharged or collected. A collection system strategy for water carried from rain gutters may include a rain barrel or a cistern.

Clogged gutters can cause water leakage into the house as the water backs up. Clogged gutters can also lead to stagnant water build up which allows mosquitoes to breed and also allow grasses and weeds to grow in the gutter. To alleviate this problem, rain gutters can be equipped with gutter screens, louvers, or solid hoods to allow water from the roof to flow through, while reducing passage of roof debris into the gutter. While these devices somewhat ameliorate the problem of clogged gutters, they themselves often contribute to the problem by collapsing into the gutter under the weight of debris that falls upon them, rusting away, diverting rainwater away from the gutter and to the foundation of the very structure the gutter is to protect, and the like.

SUMMARY OF THE INVENTION

A detritus exclusion appliance is provided that includes a support that is preferably, but not necessarily, constructed of extruded aluminum and that comprises a screen made of surgical grade stainless steel wire mesh that prevents debris from entering rain gutters. The support is preferably formed of an extruded material that includes one or more upwardly projecting support beams. A center beam may project upwardly beyond beams to either side of it to create a curved profile in which the wire mesh is curved along an axis of the support to slope downwardly on either side of the center beam. This arrangement assists in shedding detritus and debris from the screen. Thus, a domed support structure is provided for added strength and to allow greater shedding of debris from the top of rain gutter appliance. Various embodiments are described.

DETAILED DESCRIPTION OF THE INVENTION

An embodiment of the invention provides a permanent solution for an annual problem. Each year, countless hours are spent cleaning clogged and debris filled rain gutters. This is a time consuming and dangerous task which is eliminated by installing the herein disclosed eaves trough appliance. Thus, the herein disclosed invention provides a unique appliance that prevents clogged eaves troughs and allows the elimination of maintenance, such as cleaning of debris and the like from eaves troughs. Leaves, pine needles, roof grit, seed pods, small organic matter, and whirly birds are thus prevented from entering the eaves trough in a rain gutter system.

Figure 1:
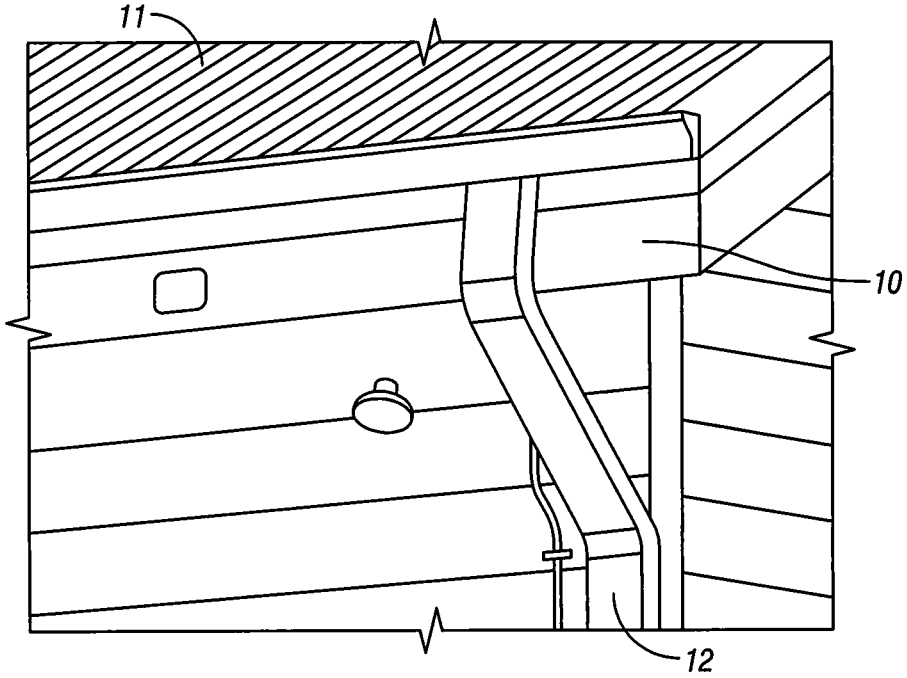
FIG. 1 (Prior Art)
FIG. 1 is a perspective view of a conventional eaves trough installed to the edge of roof to catch rainwater shed by the roof and divert it to a downspout.
Figure 2:
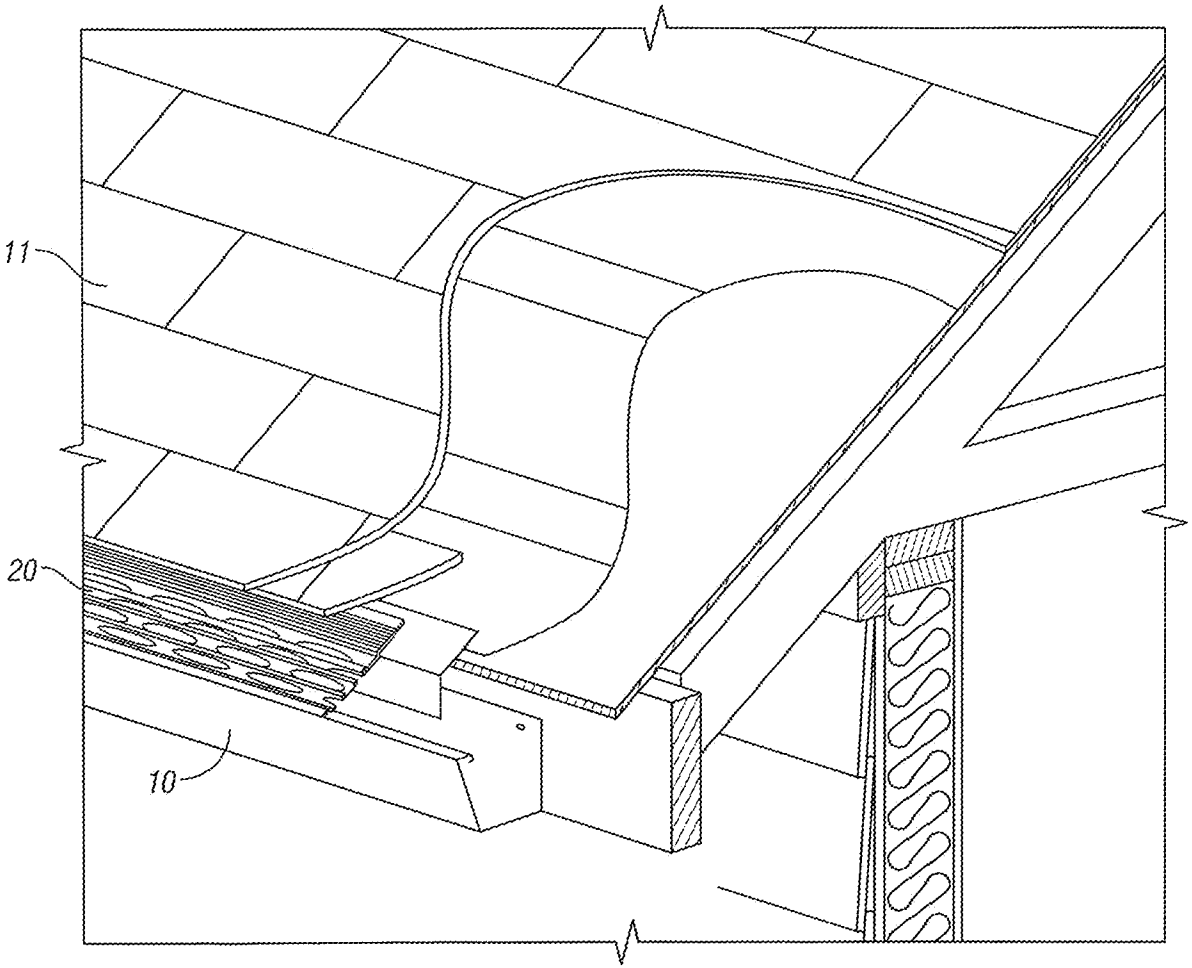
FIG. 2 is a perspective view of a roof having an eaves trough and including a detritus exclusion appliance according to the invention.

FIG. 2 is a perspective view of a roof having an eaves trough and including a detritus exclusion appliance 20 according to the invention. In FIG. 2, an eaves trough is covered by the appliance 20 herein disclosed.

Figure 3:
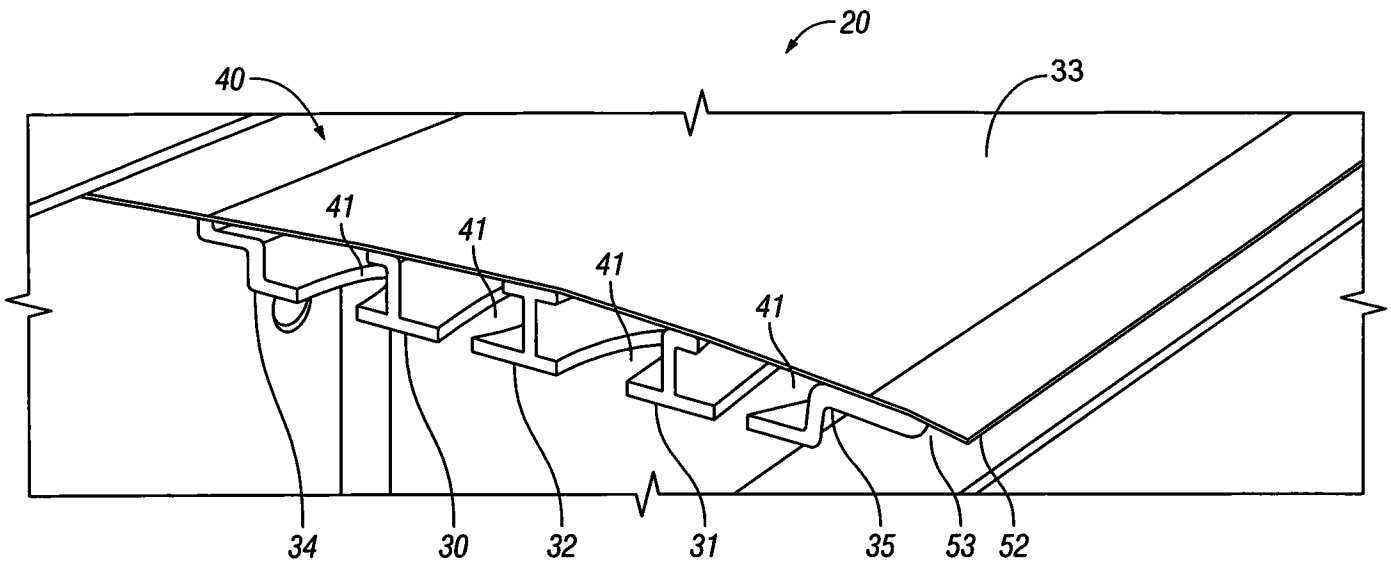
FIG. 3 is a perspective view of a detritus exclusion appliance according to the invention.

FIG. 3 is a perspective view of detritus exclusion appliance 20 according to the invention. As shown in FIG. 3, a presently preferred embodiment of the invention comprises an appliance 20 that includes a support 40 that is preferably, but not necessarily, constructed of extruded aluminum and that comprises a screen made of surgical grade stainless steel wire mesh 33 that prevents debris from entering rain gutters. The support is preferably formed of an extruded material that includes one or more upwardly projecting support beams 30, 31, 32. A center beam may project upwardly beyond beams to either side of it to create a curved profile in which the wire mesh is curved along an axis of the support to slope downwardly on either side of the center beam. The wire mesh is configured to present a domed profile that adds to strength to the appliance and allow it to handle heavy debris prior to shedding off of rain and to support small animals. Thus, this arrangement assists in shedding detritus and debris from the screen. Accordingly, a domed support structure is provided for added strength and to allow greater shedding of debris from the top of rain gutter appliance.

A lip 34 is provided at one edge of the support to engage with the roof and a step 35 is provided at the other edge of the support to engage the support within the eaves trough. The lip may be constructed, for example, as a flange that engages beneath a roof covering, e.g. under roofing tiles, panels, shingles, or sheeting. In an embodiment, the lip is provided with a plurality of apertures 37 formed therethrough, each aperture constructed to receive a fastener therein for securing the lip to a roof. A plurality of oval punch outs 41 are defined within the support to allow water to flow to the trough relatively unimpeded. Grooves 61 (FIG. 4) formed on the top and bottom of the flange allow for ease of trimming the appliance for installation by providing guides for a straight cut. The flange is tapered to allow for ease of installation and to limit ramping of shingles or roofing material.

The presently preferred embodiment of the herein disclosed appliance is constructed of a 6063 extruded tempered (T5) aluminum support structure having a clear anodizing (anodic oxidation) finish and a T304 stainless steel plain weave wire mesh for filtering. Those skilled in the art will appreciate that other materials may be used to practice the invention.

Figure 4:
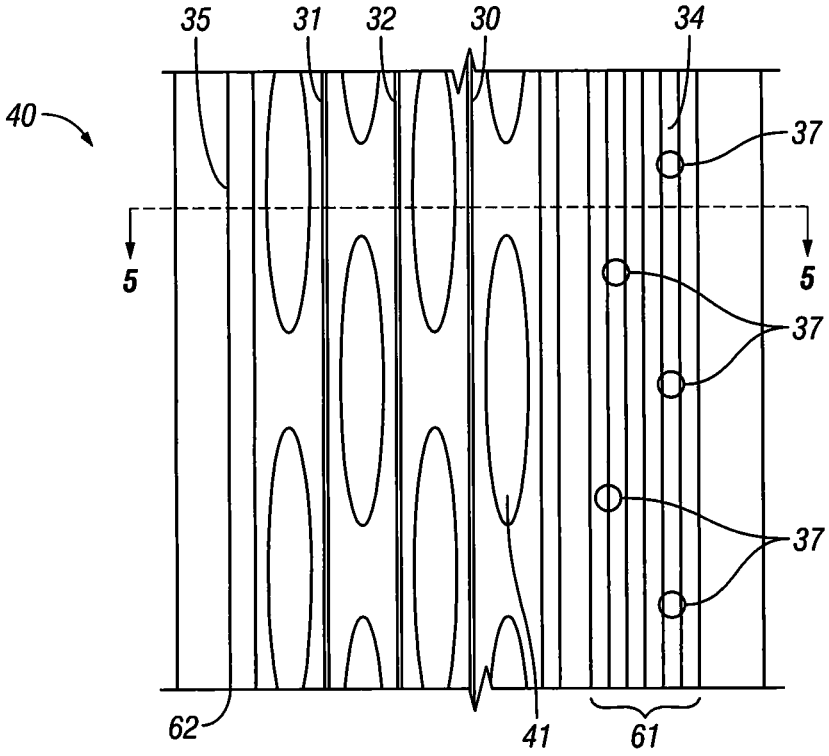
FIG. 4 is a top plan view of a support structure for a detritus exclusion appliance according to the invention.
Figure 5:
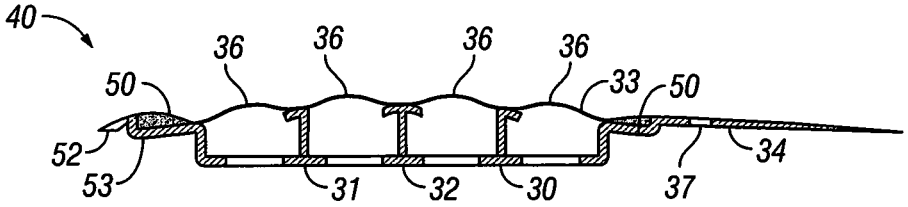
FIG. 5 is a side, section view of a support structure for a detritus exclusion appliance according to the invention.

FIG. 4 is a top plan view of a support structure for a detritus exclusion appliance according to the invention; and FIG. 5 is a side, section view along section 5-5 in FIG. 4, showing a support structure for a detritus exclusion appliance according to the invention. Those skilled in the art will appreciate that the various dimensions can be provided as appropriate for the application to which the invention is put.

As shown in FIG. 5, the screen has a profile that forms series of upwardly projecting arcs 36 above the support beams 30, 31, 32. This arrangement prevents the forming of depressions between the support beams that can trap debris and impair operability of the device.

The appliance herein disclosed is configured to install on a vast majority of eaves troughs (4"/5" or 6"/7" in width) including curved, fascia, half round, K-style and ogee by fastening to the front lip of existing eaves troughs with self-drilling screws. In an embodiment, the finish comprises a durable surface coating is provided that adheres to American Architectural Manufacturers Association (AAMA) standards, is environmentally responsible, long lasting, low maintenance, scratch resistant, and that provides tough performance. A binding agent 50 (FIG. 5), in a presently preferred embodiment a 10096 silicone structural sealant, adheres the stainless steel wire mesh into each support frame groove.

Additional key design and functionality features include the oval punch outs 41 in extruded aluminum support frame to allow for a higher flow of water to be filtered by the rain gutter appliance and into the rain gutter during heavy rain storms. A front drip edge 52 (see FIGS. 3 and 5) limits "Tiger Striping" from water condensation running down the vertical face of the aluminum or steel rain gutter.

A nodule 53 under front drip edge allows for adhering of Christmas lights with plastic clips or hangers. Arcs in the form of curved upper surfaces (see FIGS. 3 and 5) are provided on top of the vertical columns to break the surface tension and activate a capillary siphoning action for maximum water flow.

The presently preferred embodiment of the invention is provided in sections that are five feet in length, although those skilled in the art will appreciate that other standard lengths may be provided and that the appliance is cut to length when necessary for installation. Each section of the appliance preferably fastens to the front lip of an eaves trough with three self-drilling screws (not shown) which, in the presently preferred embodiment comprise hex washer head #2 forged Stalgard coated self-drilling screws. A groove 62 (FIG. 4) on the front lip allows for ease of installation by providing a guide for screw placement. The appliance typically fits eaves troughs of 2.5" to 7" in width.

Additional Embodiments

An embodiment is provided such that both side channels into which the stainless steel wire mesh slides have been increased by a couple of degrees to allow for more sealant to be inserted thereby providing greater long-term adhesion. An embodiment may be understood with reference to FIGS. 6-9. For example, such degrees may include but are not limited to 4 degrees to 10 degrees for side channels 51*a* and 51*b*.

Figure 6:
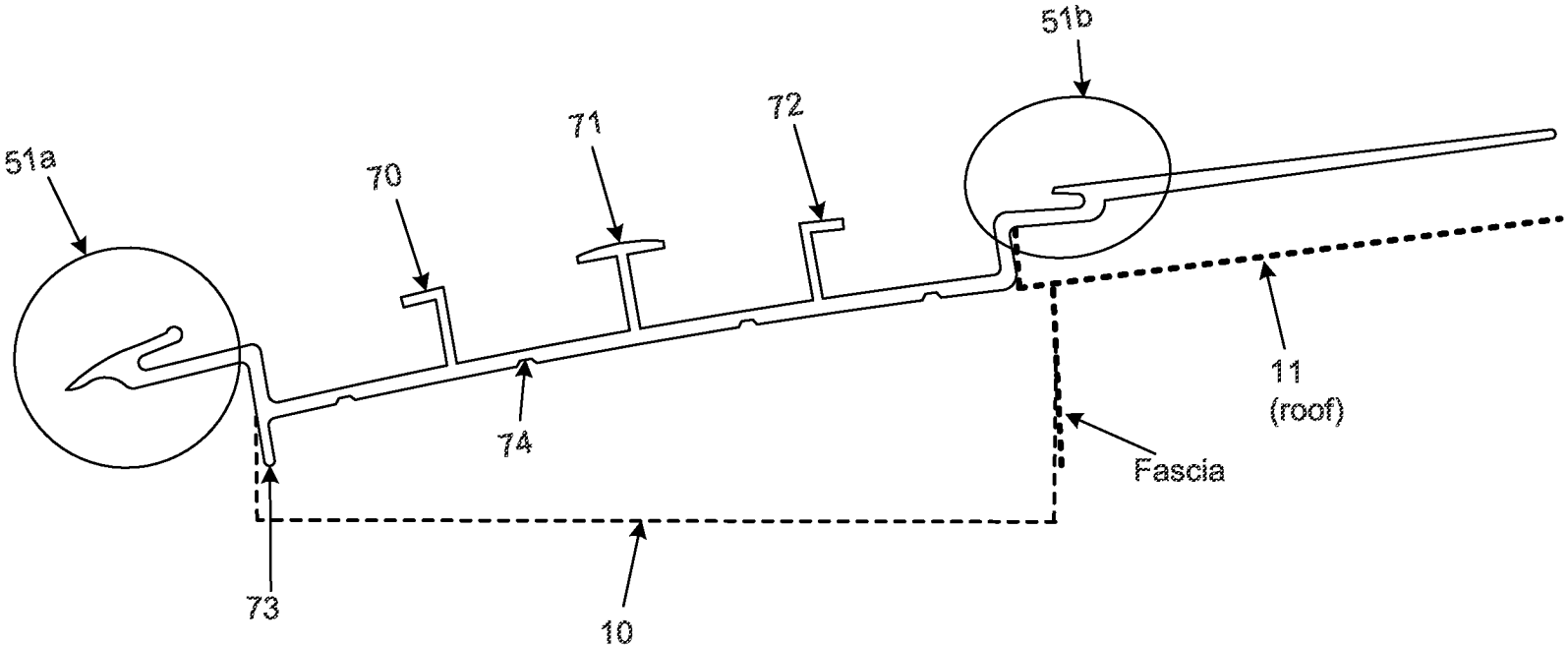
FIG. 6 is a side, section view of a support structure for a detritus exclusion appliance according to the invention.
Figure 7:
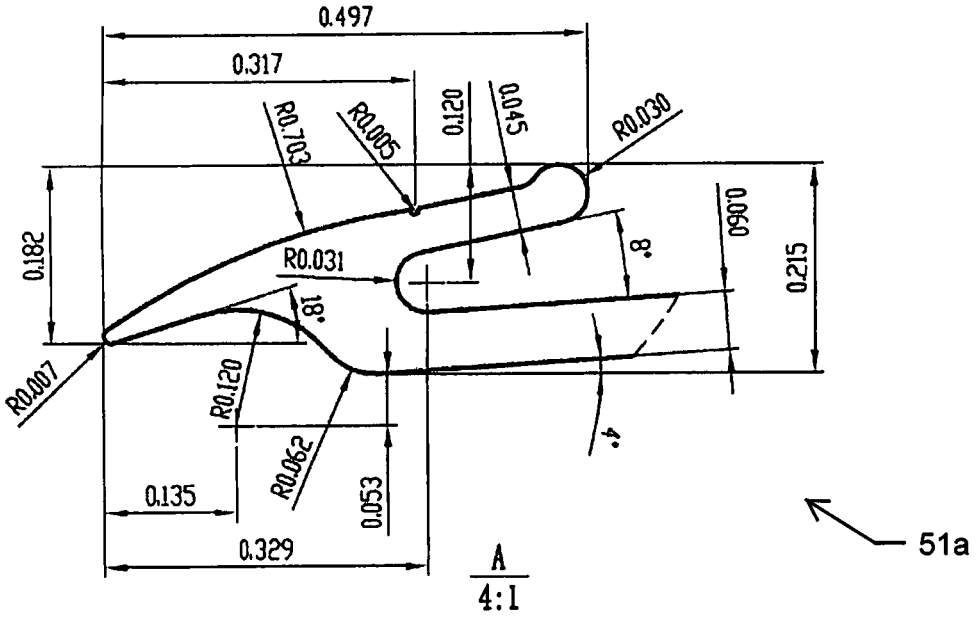
FIG. 7 is a side, section view of a side channel for a detritus exclusion appliance according to the invention.
Figure 8:
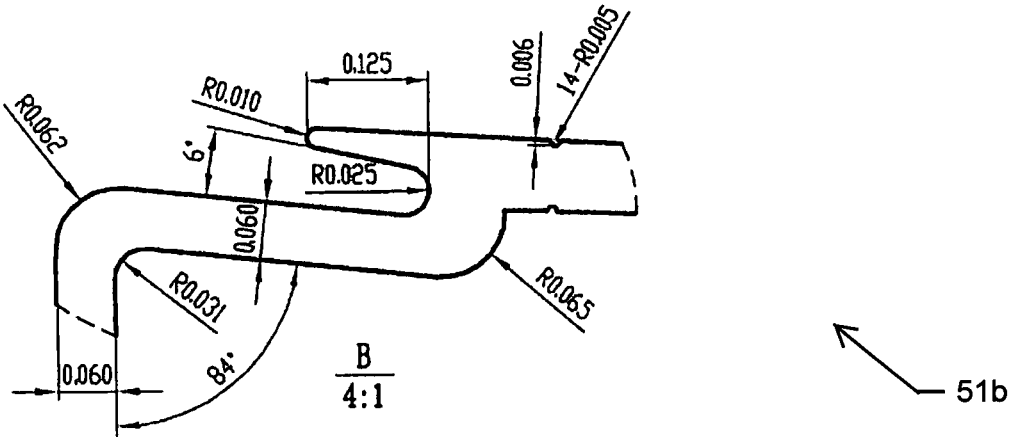
FIG. 8 is a side, section view of a side channel for a detritus exclusion appliance according to the invention.
Figure 9:
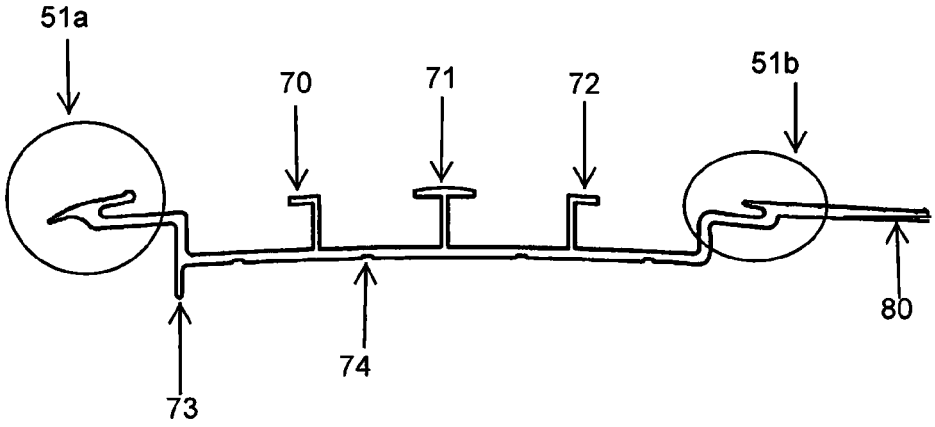
FIG. 9 is a side, section view of a support structure for a detritus exclusion appliance according to the invention.

Embodiments are provided and depicted in FIG. 6 and FIG. 9 such that each width on all three (3) of the arcs 70, 71, and 72, is configured to allow for more extruded aluminum to touch stainless steel wire mesh 33. For example, such widths may include but are not limited to 0.175" to 0.035" widths, including at those widths for half arcs or full arcs.

An embodiment is provided that comprises a drop down channel 73 on a leading edge. Such embodiment may be understood with reference to FIG. 6 or FIG. 9. An exemplary length may be 0.1875" length. It should be appreciated that one purpose of drop down channel 73 on a leading edge is for ease of installation and to ensure a tight fit against the eaves channel, eaves trough, gutter, or guttering. As well, such drop down channel may force any residual water flow from the underneath side of the eaves trough detritus deterrent appliance 20 into the eaves channel, eaves trough, gutter, or guttering for maximum water collection.

An embodiment is provided that comprises a siphoning channel groove 74 on the underneath side of eaves trough detritus deterrent appliance 20. In an embodiment, siphoning channel groove 74 runs the entire length of the embodiment inline with oval shaped punch outs 41. Such embodiment may be understood with reference to FIG. 6 or FIG. 9. In an embodiment, siphoning channel groove 74 directs any residual water flow from the underneath side of eaves trough detritus deterrent appliance 20 to the oval shaped punches and into the eaves channel, eaves trough, gutter, or guttering for maximum water collection.

An embodiment is provided that comprises increased length and width of oval shaped punches 41. In an embodiment, increased length and width of oval shaped punches 41 may be, but are not limited to, 0.50" width×3.25" length× R0.150". In an embodiment, such dimensions may be increased by 20 percent to 25 percent. Such dimensions as well as others allow for a higher volume of metered water flow from eaves trough detritus deterrent appliance 20 into the eaves channel, eaves trough, gutter, or guttering for maximum water collection.

Figure 10:
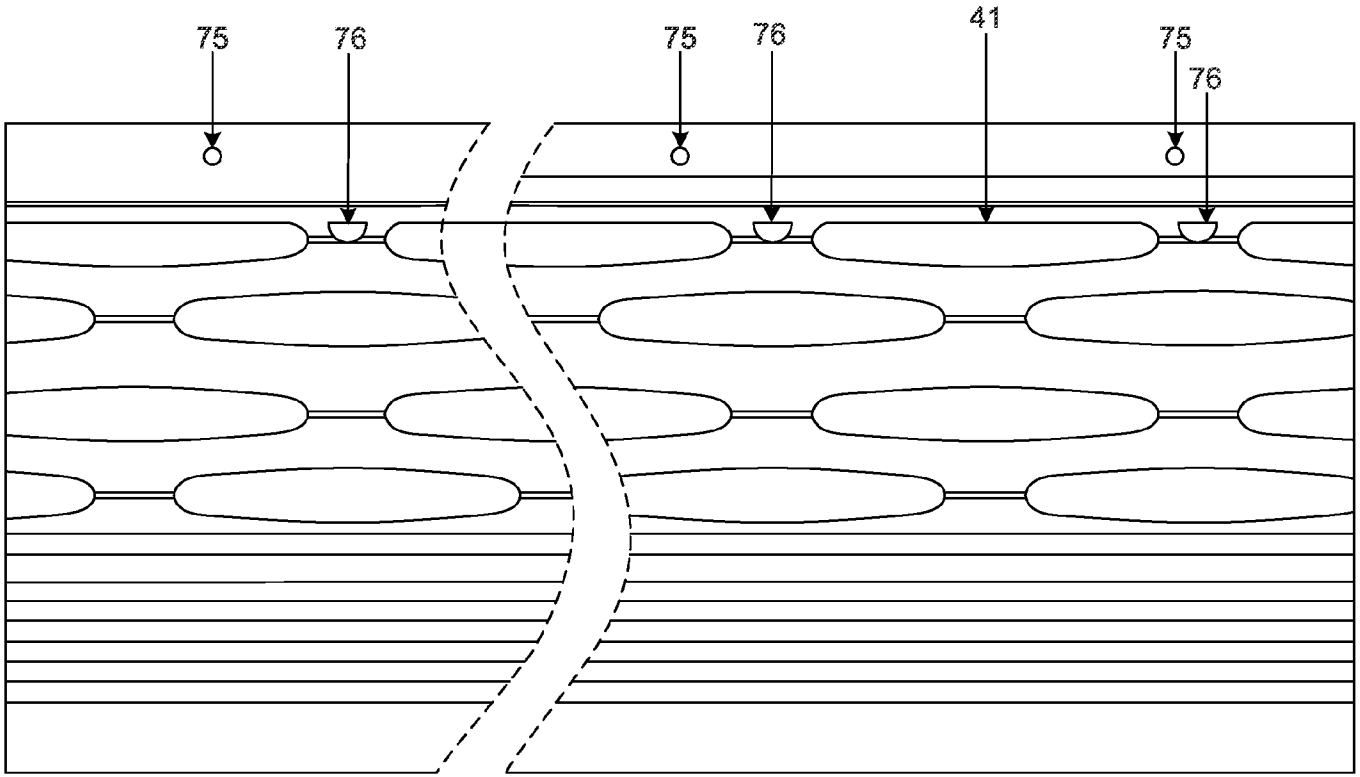
FIG. 10 is a top plan view of a support structure for a detritus exclusion appliance according to the invention.

An embodiment is provided where pre-drilled holes 75 were increased in size. Such embodiment may be understood with reference to FIG. 10. An exemplary embodiment provides a hole size diameter of 0.1563". In an embodiment, such dimensions may be increased by 20 percent to 25 percent.

Such increase in size of pre-drilled holes 75 provide greater ease of installation to ensure a tight fit against the eaves channel, eaves trough, gutter, or guttering and minimize the potential for "mushrooming" when using the Stalgard® coated self-drilling screws.

An embodiment is provided that comprise half round punches 76 on the leading edge of the front channel. An embodiment can be understood with reference to FIG. 10, in which half round punches 76 are each 0.400" diameter× R0.200. In an embodiment, half round punch 76 on the leading edge intersects the siphoning channel groove 74 to capture any residual water flow from the underneath side of eaves trough detritus deterrent appliance 20 into the eaves channel, eaves trough, gutter, or guttering for a higher volume of metered water flow for maximum water collection.

An embodiment is provided such that eaves trough detritus deterrent appliance 20 is adjustable. For example, a back wing is narrowed, e.g. by one inch than a standard manufacture, for particular install applications not able to tuck under roofing material, steeper roof pitches, or end user preference, such as depicted in FIG. 9 element 80. For example, such embodiment may be used to facilitate tucking under the roofing material or steeper pitches. Further, an embodiment is provided such that it may be designed to work in conjunction with particular channels provided by Lynch Aluminum Mfg. Co., Peoria, Ill. or a similar support channel.

An embodiment is provided such that one or more heat cables may be integrated in any of the four (4) channels between 70, 71, and 72 as shown in FIG. 6 and FIG. 9. In one embodiment, any particular embodiment is convertible to a heated version by a heat cable being integrated in any of the four (4) channels. In an embodiment, such heat cable may be installed by a licensed electrical contractor. Such heat cables may be installed for de-icing any part of eaves trough detritus deterrent appliance 20, for preventing icicles from forming on any part of eaves trough detritus deterrent appliance 20, or for preventing other ice-related complications.

Although the invention is described herein with reference to the preferred embodiment, one skilled in the art will readily appreciate that other applications may be substituted for those set forth herein without departing from the spirit and scope of the present invention. Accordingly, the invention should only be limited by the Claims included below.

The invention claimed is:

1. A detritus exclusion appliance, comprising:

an elongate support structure constructed to engage with and overlay an eaves trough along a length thereof, said support structure comprising an upwardly projecting, axial support beam, a siphoning channel groove, and a plurality of inline oval-shaped punch outs, said siphoning channel groove being on an underneath side of said elongate support structure and running along an entire length of the plurality of inline oval-shaped punch outs and in between each oval-shaped punch out to direct any residual water flow from the underneath side into the eaves trough, said support structure further defining a plurality of apertures formed therethrough along a length thereof; and a mesh screen secured to and supported by said support structure and overlaying said eaves trough, said mesh screen formed to have openings that admit water therethrough to said eaves while excluding debris therefrom.

2. The appliance of claim 1, wherein the structure comprises two side channels into which the mesh screen slides, wherein the side channels are from 4 degrees to 10 degrees wide.

3. The appliance of claim 1, wherein the structure is constructed of extruded aluminum, and wherein the structure comprises arcs configured to allow for an increased contact area between the extruded aluminum and the mesh screen.

4. The appliance of claim 3, wherein the widths of the arcs are from 0.175" to 0.035".

5. The appliance of claim 3, wherein a heat cable is integrated in any channels between the arcs of the structure.

6. The appliance of claim 3, wherein the arcs comprise half arcs and full arcs.

7. The appliance of claim 1, wherein the structure comprises a drop down channel on a leading edge for ease of installation and to ensure a tight fit against the eaves channel.

8. The appliance of claim 7, wherein the drop down channel has length 0.1875".

9. The appliance of claim 7, wherein the drop down channel is configured to force any residual water flow from the underneath side into the eaves channel.

10. The appliance of claim 1, wherein the plurality of inline oval-shaped punch outs have dimensions of 0.50" width ×3.25" length ×R0.150" for allowing a higher volume of metered water flow into the eaves channel.

11. The appliance of claim 1, wherein the structure comprises pre-drilled holes having diameters of 0.1563" for providing greater ease of installation to ensure a tight fit against the eaves channel and minimizing a potential for mushrooming when using particular screws.

12. The appliance of claim 1, wherein the structure comprises half round punches on a leading edge of a front channel.

13. The appliance of claim 12, wherein the half round punches are each 0.400" diameter.

14. The appliance of claim 12, wherein the half round punches intersect the siphoning channel groove to capture any residual water flow from the underneath side into the eaves channel.

15. The appliance of claim 1, wherein the structure is configured to be adjustable.

16. The appliance of claim 15, wherein the structure comprises a back wing having a narrowed width for adjusting the structure for particular install applications, the particular install applications including at least one install applications not able to tuck under roofing material, install applications having steep roof pitches, or install applications customized via end user preference.

17. The appliance of claim 15, wherein the structure is configured to be adjustable to work in conjunction with particular channels provided by Lynch Aluminum Mfg. Co., Peoria, Ill.

* * * * *